US007052294B1

(12) United States Patent
Osada

(10) Patent No.: US 7,052,294 B1
(45) Date of Patent: May 30, 2006

(54) ELECTRICAL CONNECTOR WITH A LOCKING MECHANISM

(75) Inventor: Tsuyoshi Osada, Farmington Hills, MI (US)

(73) Assignee: J.S.T. Corporation, Farmington Hills, MI (US)

( * ) Notice: Subject to any disclaimer, the term of this patent is extended or adjusted under 35 U.S.C. 154(b) by 0 days.

(21) Appl. No.: 11/107,233

(22) Filed: Apr. 15, 2005

(51) Int. Cl.
*H01R 13/62* (2006.01)

(52) U.S. Cl. ..... 439/157

(58) Field of Classification Search ..... 439/157, 439/372, 152–155, 341–343, 310, 160
See application file for complete search history.

(56) References Cited

U.S. PATENT DOCUMENTS 6,537,105 B1 * 3/2003 Higashida et al. ..... 439/528
6,540,532 B1 * 4/2003 Martin et al. ..... 439/157
6,878,002 B1 * 4/2005 Osawa et al. ..... 439/157
6,916,135 B1 * 7/2005 Tanaka ..... 403/322.4

* cited by examiner

*Primary Examiner*—J. F. Duverne
(74) *Attorney, Agent, or Firm*—Osha Liang LLP

(57) ABSTRACT

An electrical connector includes a housing and a lever supported pivotally on at least one pivot disposed on the housing. The lever rotates on the pivot within a range from a pre-engagement position to a final engagement position. The lever also has a recess configured to fit a boss disposed on a mating connector therein in accordance with rotational movement of the lever. Further, the lever includes a connector locking portion disposed on a beam thereof. The connector locking portion includes a base portion extending downward from the beam, a flap portion supported by the base portion and extending in a direction substantially tangent to the rotational movement, and a detent disposed in proximity of a first free end of the flap portion such that the detent engages with an engaging portion disposed on the housing at the final engagement position.

16 Claims, 7 Drawing Sheets

ELECTRICAL CONNECTOR WITH A LOCKING MECHANISM

BACKGROUND OF INVENTION

1. Field of the Invention

The invention relates generally to electrical connectors, and particularly to an electrical connector with a locking mechanism that assures a combination with a mating electrical connector.

2. Background Art

An electrical connector is a core component used in many electronic systems to connect wiring harnesses. In recent years, electronic systems have grown increasingly complicated. As a consequence, the number of electrical connectors used in some electronic systems has increased, along with the number of wiring harnesses. Some relatively large connectors have also been developed, which may be provided with several dozen terminals or poles. Such connectors may typically include sub housings or sub connectors corresponding to terminals of various types, such as optical fibers and electrical wires for communication and for power.

Connectors are typically manufactured by a connector manufacturer, and thereafter supplied to a harness assembler to attach wiring harnesses thereto. In the process of assembling a female connector, the terminals disposed at an end of the wiring harnesses may be inserted into a housing from a rear side of the housing. The female connector is typically provided with detents, which may be referred to as housing lances, within the housing thereof. When the terminals of the wiring harnesses are inserted into the housing, a portion of the housing lances may be moved upward due to interference with the terminals, and the lances may thereafter "snap" back to engage with notches of the terminals. The TPA (Terminal position Assurance) member is then inserted into the housing, and bridges a gap in the housing to restrict undesirable movement of the housing lances. For example, the TPA member is inserted into the housing from a front side surface of the housing, and thereby the TPA member bridges the gap, restricting the movement of the lances. The resulting female connector, as is a final product, can be combined with a mating connector, i.e., a male connector. Larger connectors typically require a greater force to combine with the mating connector. Accordingly, the larger connectors are generally provided with an insertion-assist mechanism, such as a lever mechanism, in order to reduce a necessary insertion force. The insertion-assist mechanism typically doubles as a connector locking mechanism to assure a reliable connection between connectors.

FIG. 1A illustrates a connector locking mechanism of a conventional female connector. The female connector 1 includes wiring harness 3, which is inserted from a rear surface of the female connector 1. The female connector 1 is about to be connected with a male connector 2 that is mounted on a printed circuit board 5 disposed within a casing 4. The female connector 1 also includes a TPA member 12 disposed at a front surface thereof. Cylindrical protrusions 13 are disposed on both side surfaces of the housing 11, and an roughly inverted-U-shaped lever 14 is pivotally supported by the protrusions 13. The lever 14 stops at a pre-engagement position as shown in FIG. 1. The lever 14 has an arcuate recess 16 configured to fit about a cylindrical boss 15 disposed on an inner surface of a housing of the male connector 2. In connecting mating connectors 1 and 2, the boss 15 comes into contact with a guide portion 16*a* of the recess 16. Subsequently, by way of rotation of the lever 14 in a direction of arrow A, the boss 15 is completely fitted into the recess 16, so as to combine the female connector 1 with the male connector 2. The lever 14 includes two arms 141 and a beam 142 supported by the two arms 141. A lever locking portion 17 made of a resin material, which has some flexibility, is suspended in proximity to the middle of the beam 142. The lever locking portion 17 has a substantially U-shaped cross section, and elastically supports a detent 17*a*. The detent 17*a* can be engaged with an engaging portion 18 disposed on a corresponding portion of the housing 11 at an engagement position, restricting rotational movement of the lever 14. Thus, the fit of the boss 15 into the recess 16 is maintained, and, as a consequence, the connection between the complementary connectors 1 and 2 is assured.

Still referring to FIG. 1A, the lever locking portion 17 of the conventional female connector 1 is configured to be suspended from the beam 142 of the inverted U-shaped lever 14 in order to avoid external impact during conveyance and the like. While the female connector 1 to which the wiring harnesses 3 are attached is conveyed to the next process, and with the lever 14 at the pre-engagement position shown in FIG. 1A, the lever locking portion 17 cannot avoid interference with the attached wiring harnesses 3. Accordingly, the lever locking portion 17 is subject to an excessive force. Over a period of time, the lever locking portion 17 eventually becomes deformed, such that the locking mechanism ceases to function properly. More specifically, as shown in FIG. 1B, the lever locking portion 17 becomes deformed such that a free end of the lever locking portion 17 acquires a gap length g', which is smaller than an original gap length g. As a consequence, engagement of the detent 17*a* with the engagement portion 18 of the housing 11 becomes shallow. Thus, even a slight force applied to the lever 14 may undesirably cause disengagement of the detent 17*a* and the engagement portion 18, thereby allowing the complementary connectors 1 and 2 to become disconnected due to rotating movement of the lever 14.

SUMMARY OF INVENTION

According to one aspect of the invention an electrical connector includes a housing and a lever supported pivotally on at least one pivot disposed on the housing. The lever rotates on the pivot within a range from a pre-engagement position to a final engagement position. The lever also has a recess configured to fit a boss disposed on a mating connector therein in accordance with rotational movement of the lever. Further, the lever includes a connector locking portion disposed on a beam thereof. The connector locking portion includes a base portion extending downward from the beam, a flap portion supported by the base portion and extending in a direction substantially tangent to the rotational movement, and a detent disposed in proximity of a first free end of the flap portion such that the detent engages with an engaging portion disposed on the housing at the final engagement position.

Other aspects and advantages of the invention will be apparent from the following description and the appended claims.

DETAILED DESCRIPTION

The invention is described with reference to an exemplary embodiment illustrated in the attached drawings and made in accordance with a corresponding method of the invention.

Figure 2:
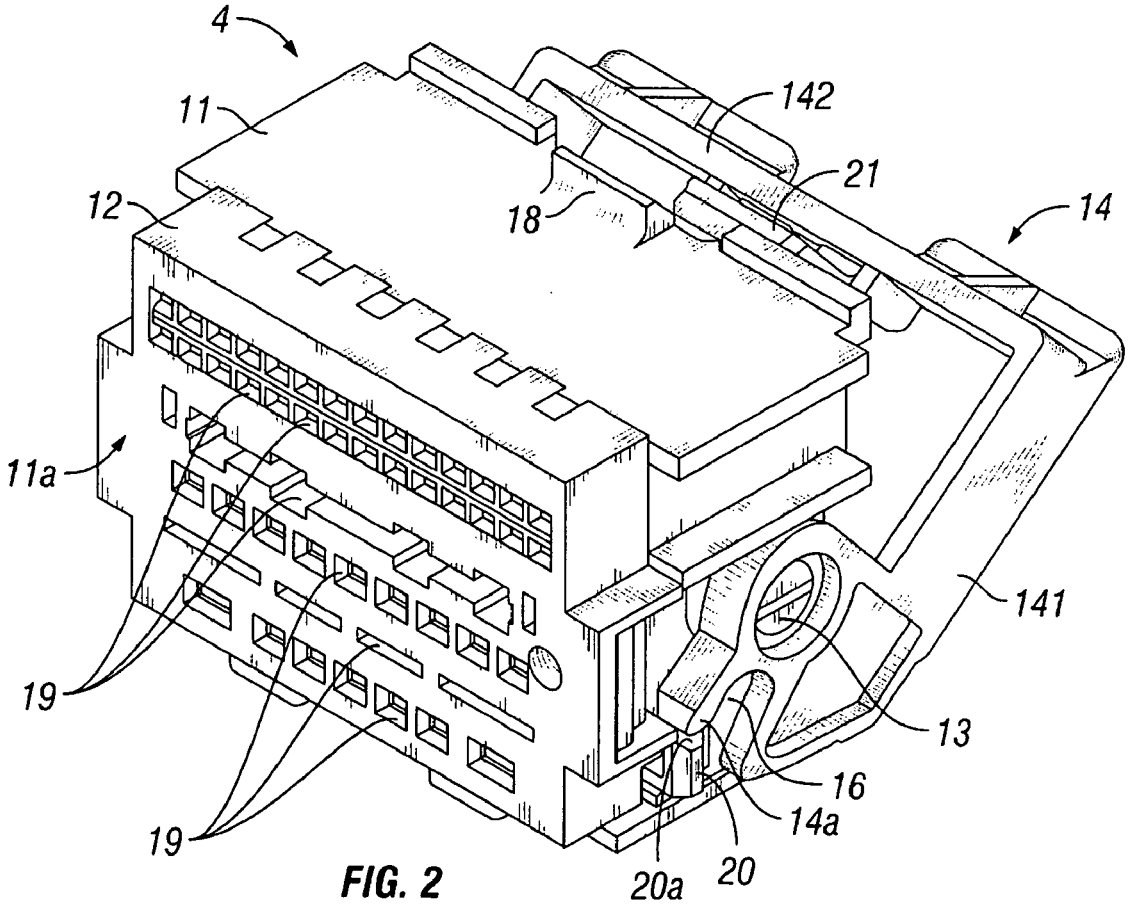
FIG. 2 illustrates a perspective view of a connector with a lever when the lever is positioned at a pre-engagement position according to an embodiment of the invention.
Figure 3:
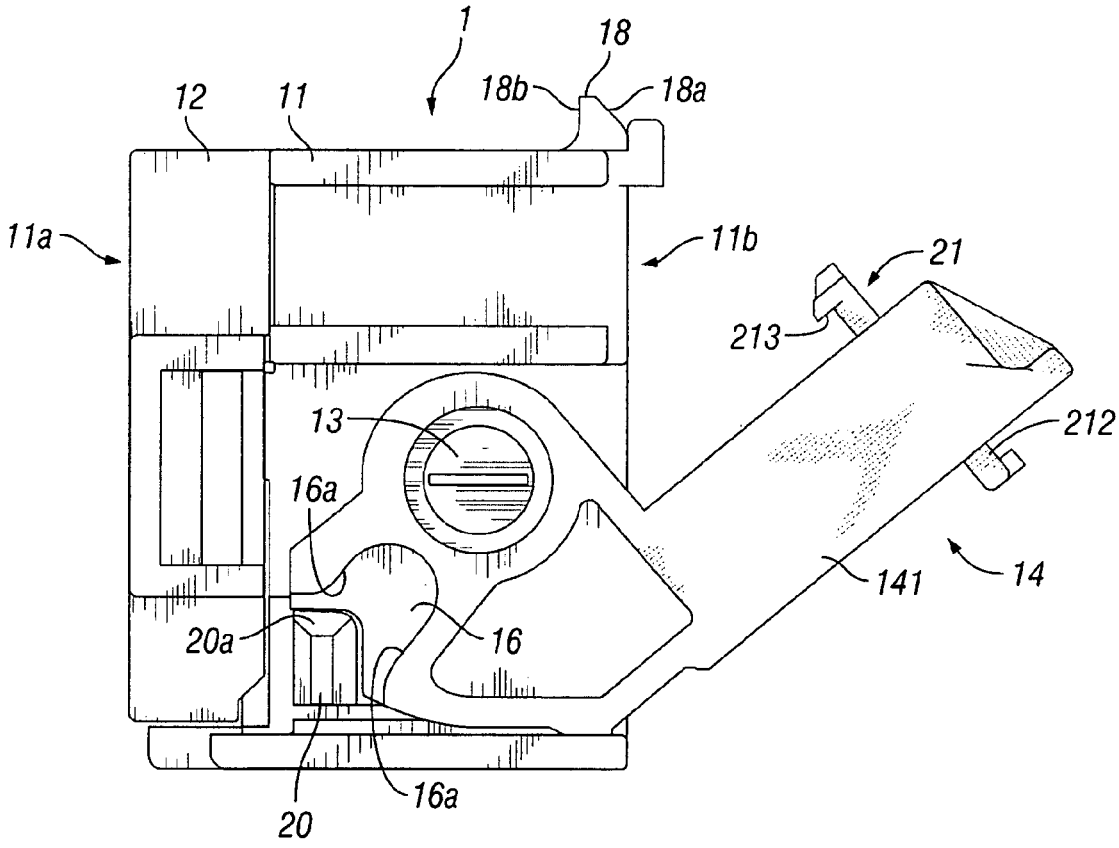
FIG. 3 illustrates a right side view of the connector shown in FIG. 2.
Figure 4:
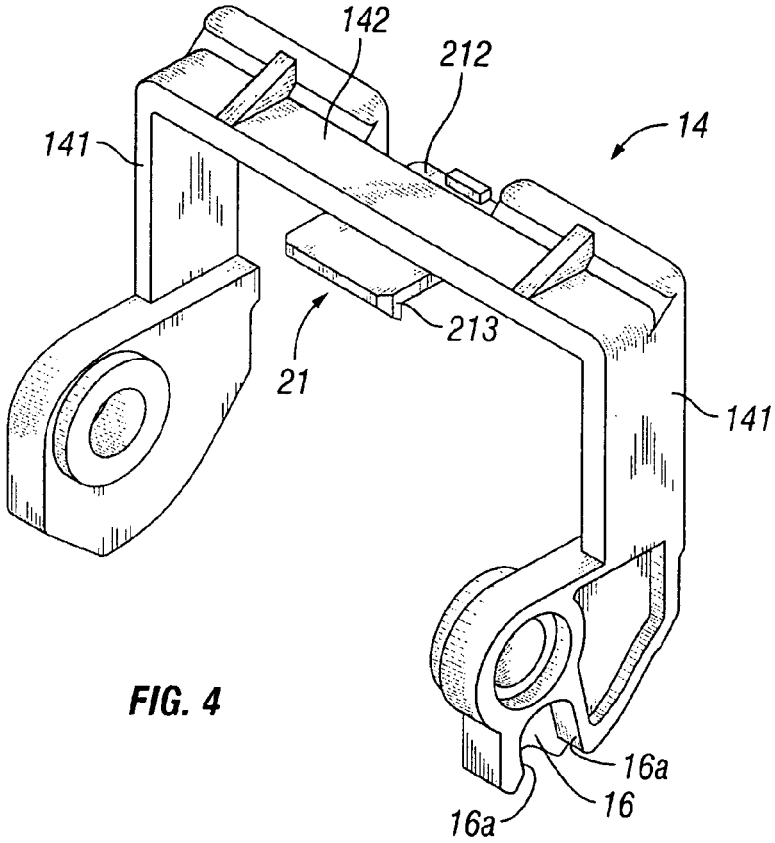
FIG. 4 illustrates a perspective view of a lever of the connector shown in FIG. 2.
Figure 5:
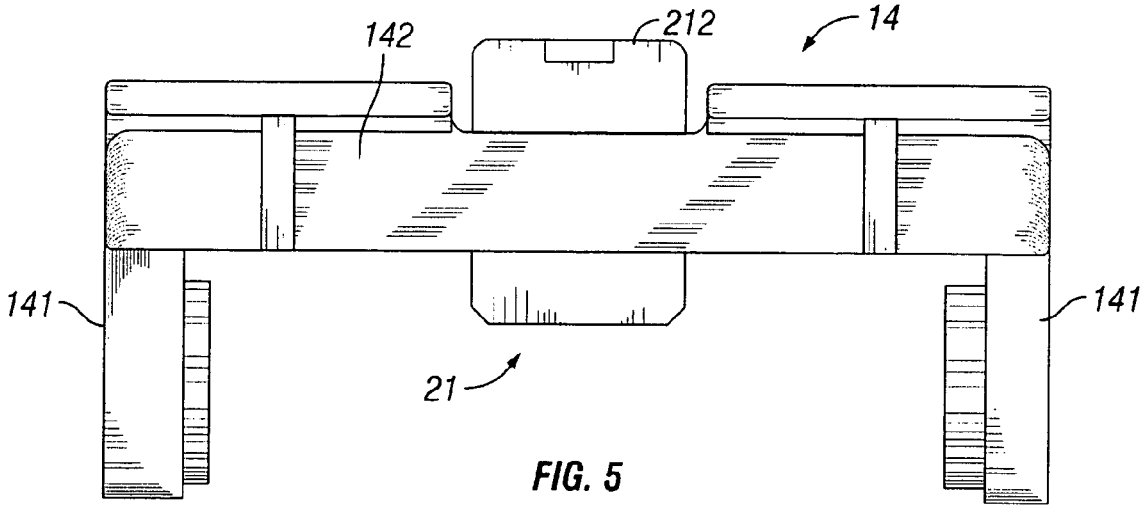
FIG. 5 illustrates a plan view of the lever shown in FIG. 5.
Figure 6:
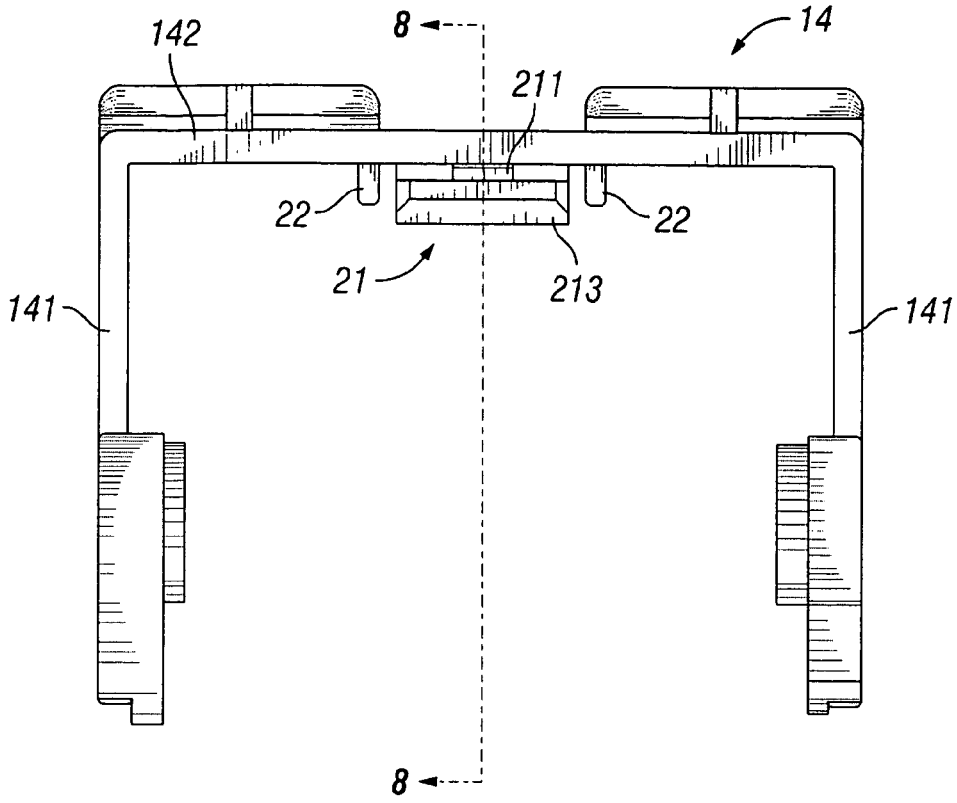
FIG. 6 illustrates a front view of the lever shown in FIG. 5.

FIGS. 2 and 3 illustrate an electrical connector according to one embodiment of the invention. Referring to FIG. 2, a female connector 1 is shown as including a female housing 11 with a lever-type connector locking mechanism 14. The connector 1 is typically manufactured by a connector manufacturer, and thereafter supplied to a harness assembler to attach wiring harnesses thereto. The connector 1 can be connected with a mating connector, i.e., a male connector, to electrically interconnect wiring harnesses. The dimensions of the housing 2 is determined to a large extent by the size and number of the terminals or poles.

The housing 11 is a single-piece component made of insulating material, such as plastic, using a molding method. The housing 11 may alternatively be formed using other known materials and methods. The housing 11 has a front receiving portion 11*a* at a front surface thereof, and a rear receiving portion 11*b* at a rear surface thereof. The front receiving portion 11*a* receives the TPA member 12 therein, and a plurality of terminal slots 19 corresponding to the number of the poles is configured accordingly. The TPA member 12 assures a proper position of the terminals of wiring harnesses 3 as described above. The plurality of terminal slots 19 on the front receiving portion 11*a* of the housing 11 are linked to a plurality of terminal slots on the rear receiving portion 11*b* through passageways within the housing 11 (not shown). The terminals disposed at ends of the wiring harnesses 3 are inserted in the terminal slots designed on the rear receiving portion 11*b* of the housing 11, while the TPA member 12 is fitted into the front receiving portion 11*a* of the housing, and whereby a female connector as a final product is configured. It is noted that FIG. 2 shows the configuration of the female connector 1 to which the TPA member 12 is already attached before inserting the wiring harnesses into the housing 11. Depending on a type of the connector 1, it is known that the connector 1 may be configured to accommodate the TPA member 12 from a side or bottom surface thereof.

The housing 11 is provided with a lever 14 that serves as a connector locking mechanism. In this embodiment, the lever 14 is formed in a roughly inverted U-shape such that a beam 142 extending laterally is supported by two arms 141 at both side ends of the beam 142. A pair of pivotal protrusions 13 formed in a cylindrical shape is disposed on both sides of the housing 11. The two arms 141 are supported pivotally on the protrusions 13, and thereby the lever 14 is configured to move rotationally on the protrusions 13. Further, a stopper 20 having a tapered portion is disposed on one side surface of the housing 11. The stopper 20 may be in contact with an edge portion 14*a* of the lever 14, and thereby the lever 14 is preliminarily restrained at a pre-engagement position. The two stoppers 20 may be disposed on the both sides of the housing 11. The stopper 20 is configured to elastically move in a substantially normal direction to the side surface of the housing 11 in response to a predetermined external force. Thus, when a certain rotational force is applied to the lever in a direction shown by an arrow A, the stopper 20 is forced into the housing 11 because of interference with the edge portion 14*a*, the lever 14 becomes movable rotationally. The lever 14 is rotationally movable within a range between the pre-engagement position and a final engagement position that a lever locking portion 21 of the lever 14 as will be described below comes into engagement with an engagement portion 18.

Figure 1A:
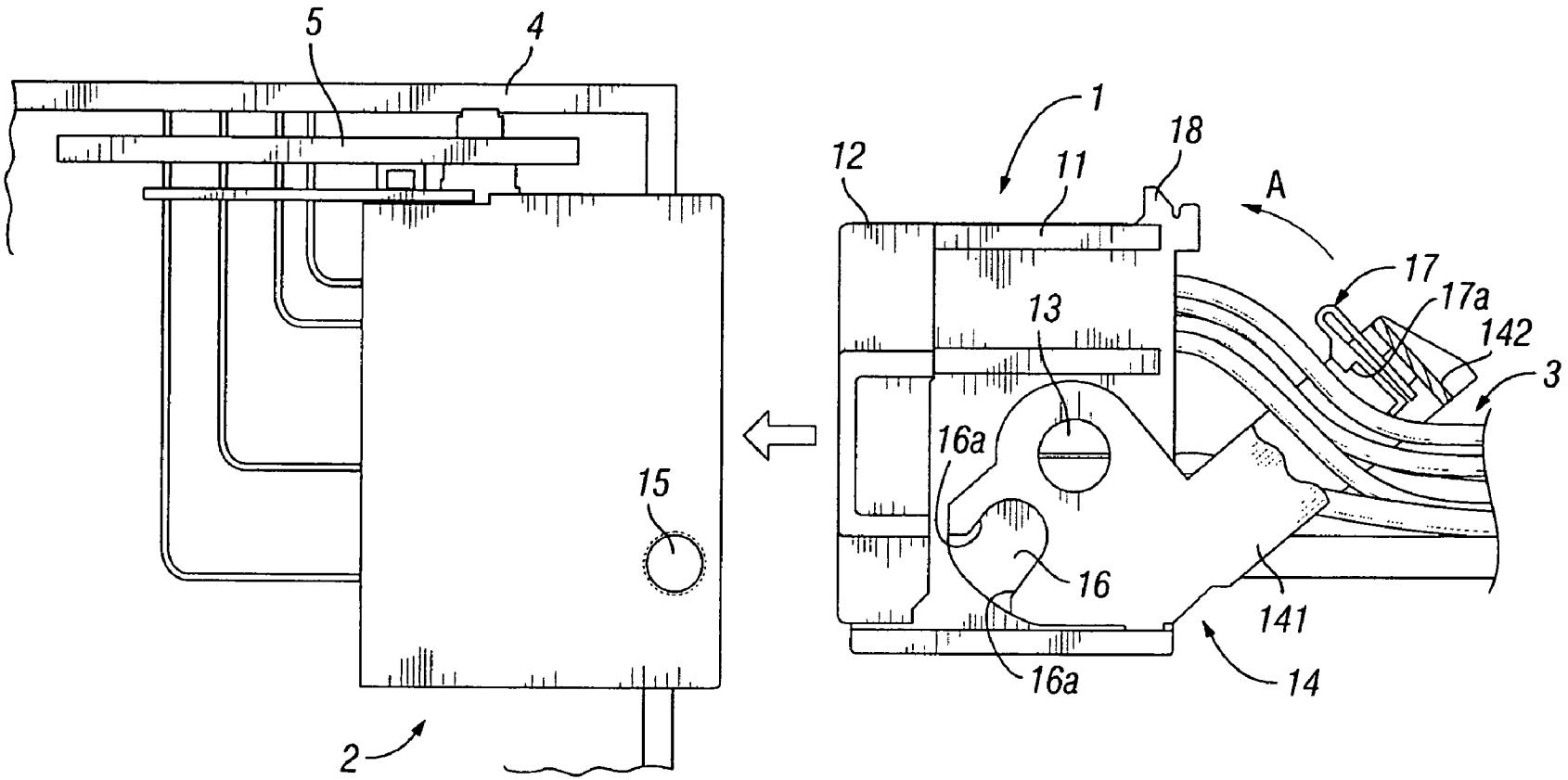
FIG. 1A (Prior Art)
FIG. 1A shows an electrical connector, having a connector locking mechanism, as it is about to be combined with a mating connector.
Figure 1B:
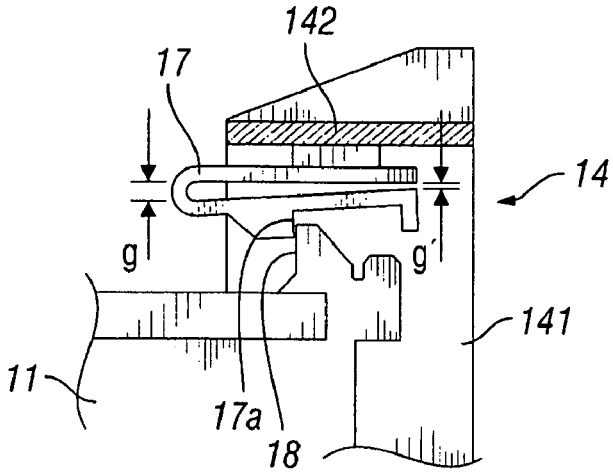
FIG. 1B (Prior Art)
FIG. 1B shows a partially enlarged view of the connector locking mechanism.

The lever 14 also includes an arcuate recess 16 that is configured to fit a boss 15 of a mating connector 2 thereinto as shown in FIG. 1A. In the process of connecting the female connector 1 and the male connector 2, the boss 15 initially comes into contact with a guide portion 16*a* of the recess 16. Subsequently, by way of rotating movement of the lever 14 in a direction of the arrow A, the boss 15 is fitted into the recess 16, in response to a reactive force between the lever 14 and the boss 15 so as to connect the female connector 1 with the male connector 2. This insertion-assist mechanism allows an insertion force to be reduced in the process of the combining, and also allows the complementary connectors 1 and 2 to be reliably combined.

Figure 7:
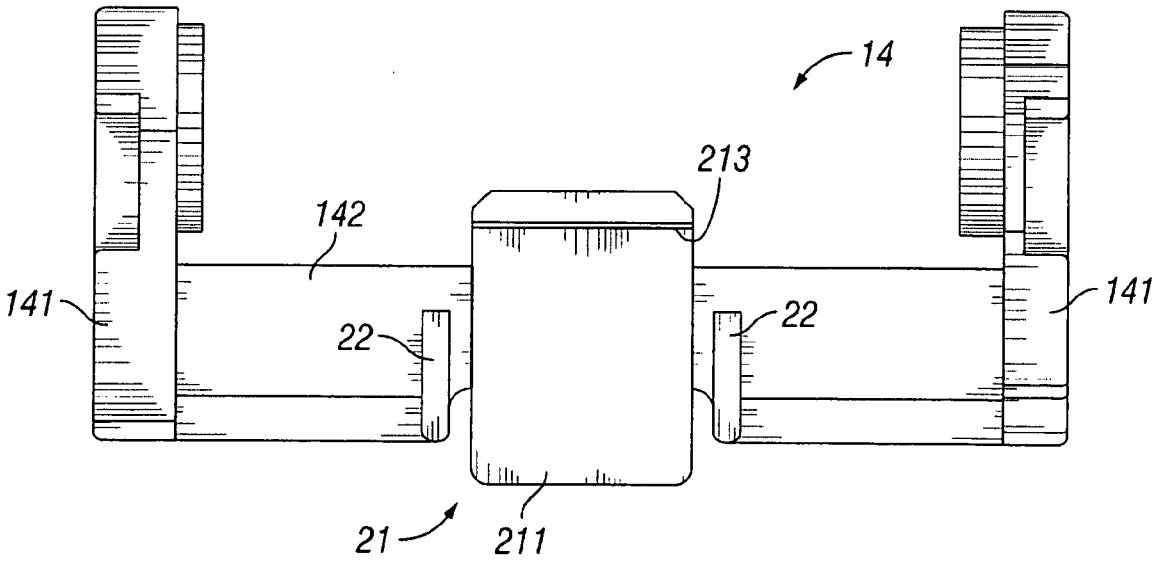
FIG. 7 illustrates a bottom view of the lever shown in FIG. 5.
Figure 8:
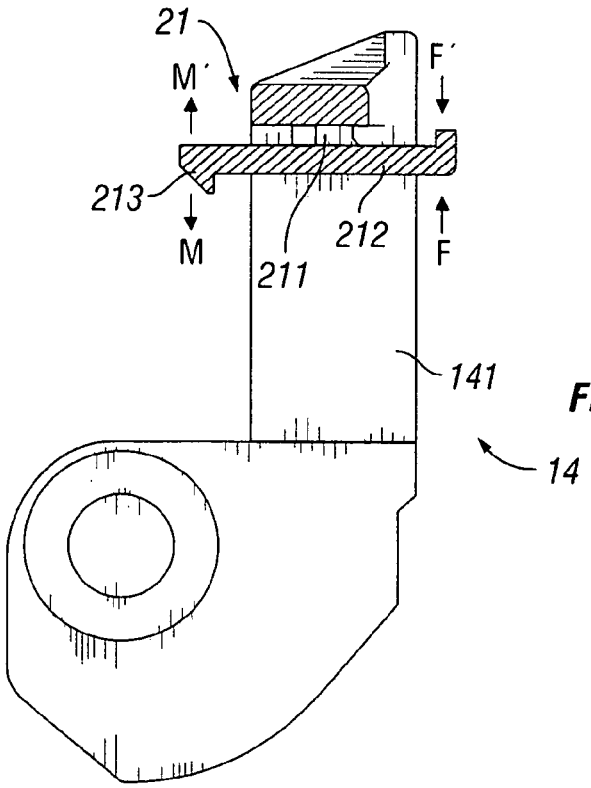
FIG. 8 illustrates a cross-sectional view of the lever taken along line 8—8 of FIG. 7.

FIGS. 4 through 8 illustrate a configuration of the lever 14 in detail. A lever locking portion 21 is disposed in proximity to the middle of the beam 142 connecting to the two arms 141. Referring now to FIG. 8, the lever locking portion 21 includes a base portion 211 extending downward from a bottom surface of the beam 141, a flap portion 212 supported by the base portion 211 and extending in a direction substantially tangent to the rotation direction, and a detent 213 on one free end of the flap portion 212 and extending downward. This configuration allows the flap portion 212 to be seesawed as the base portion 211 that acts as a fulcrum. Specifically, when an external force F is applied to the opposite end portion of the flap 212 upward, the detent 213 is displaced downward as denoted by an arrow M. By contrast, when an external force F' is applied to the opposite end portion downward, the detent 213 is displaced upward as denoted by an arrow M'. Although the flap portion 212 is formed in a rectangle shape as shown in FIG. 7, those of ordinary skill in the art will appreciate that this configuration may be modified without departing from the scope of the invention.

Figure 9:
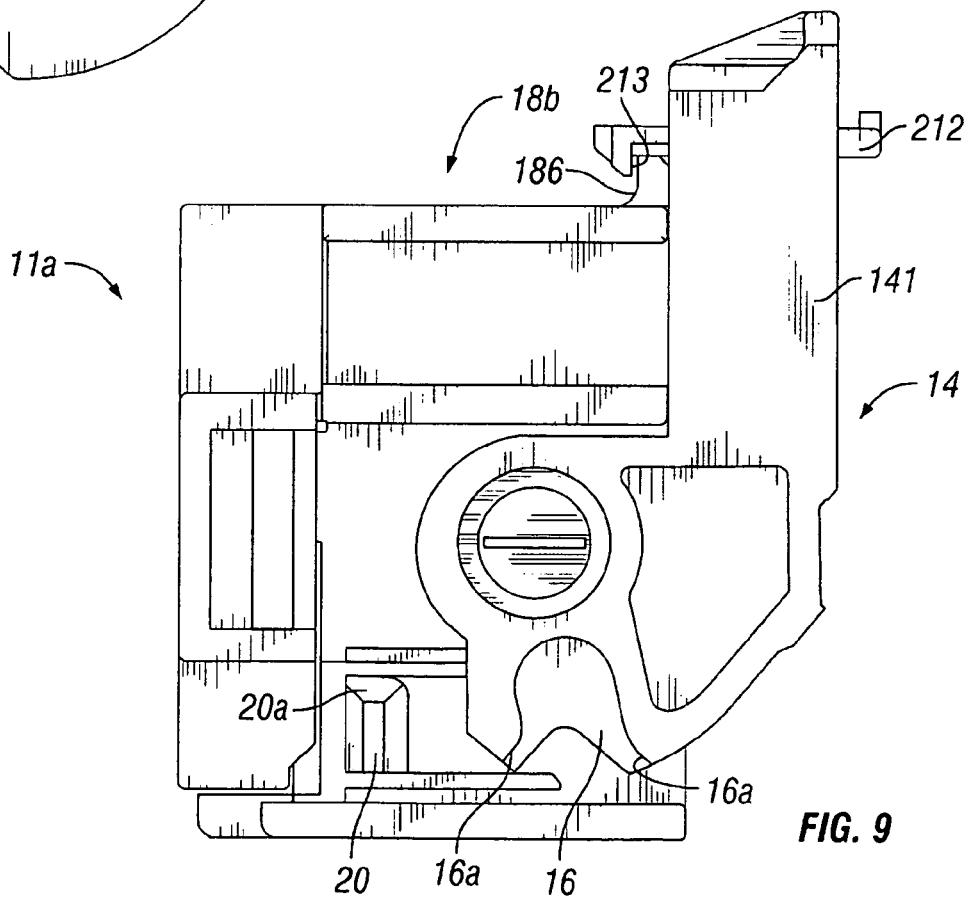
FIG. 9 illustrates a right side view of the connector when the lever is positioned at a final engagement position according to an embodiment of the invention.

As best shown in FIG. 3, the engagement portion 18, which engages with the detent 213, is disposed in proximity to a rear, top portion of the housing 11. As a result of the rotating movement of the lever 14, the detent 18, which is approaching the engagement portion 18 of the housing 11, is moved upward due to interference with a tapered portion 18*a* of the engagement portion 18. Thereafter, the detent 213 snaps back to engage with an engagement surface 18*b*. Thus, the rotating movement of the lever 14 is restrained at the final engagement position. FIG. 9 shows that the lever 18, which is positioned at the final engagement position, engages with the engagement portion 18. By virtue of this configuration, during the process of connecting with the mating connector 2, the movement of the boss 15 into the recess 16 is maintained. As a consequence, the connection between the complementary connectors 1 and 2 is reliably assured.

Referring to FIG. 7, the lever 14 may have ribs 22 disposed in proximity to the lever locking portion 21 of the beam 142. The ribs 22 are configured to extend along each side of the lever locking portion 21. The ribs 22 allows the lever locking portion 21 to be protected from an excessive force applied to the lever locking portion 21. Also, the ribs 22 may prevent the wiring harnesses 3 from intruding into a gap between the beam 142 and the flap 212. Additionally, the ribs 22 may help a user or assembler to easily release the engagement of the lever locking portion 21 with the engagement portion 18 in that a finger of the user can engage the ribs 22.

Figure 10A:
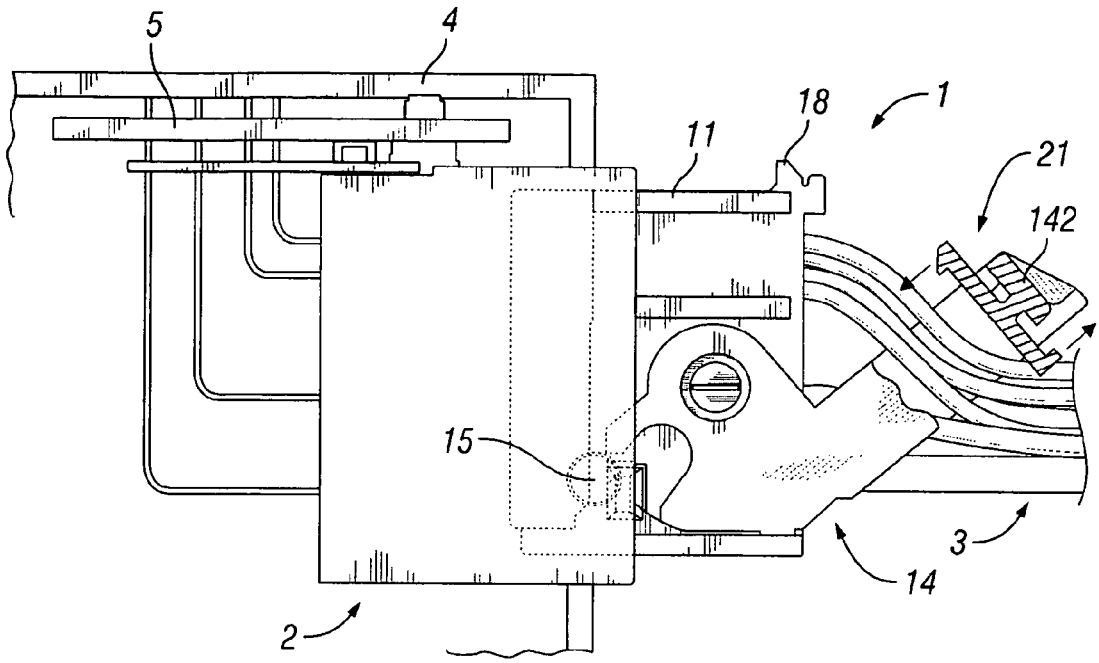
FIG. 10A is a diagram showing interference of a lever locking portion of the connector with wiring harnesses according to an embodiment of the present invention.
Figure 10B:
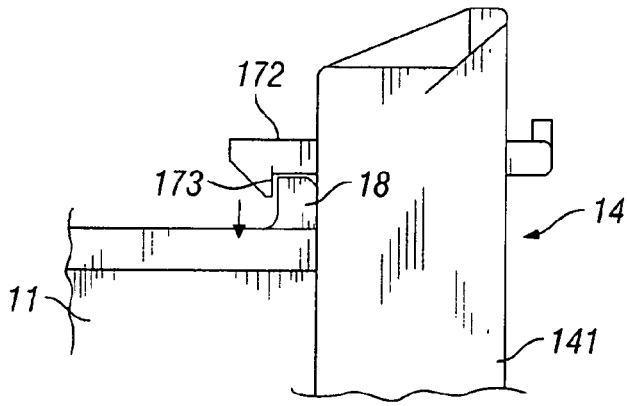
FIG. 10B illustrates an engaged state of the lever locking portion with an engaging portion of the housing.

The connector 1 discussed above is intended to be connected with the mating connector after the wiring harnesses 3 is inserted into the connector 1. Prior to such connection with the mating connector, the lever 14 of the connector 1 is held at the pre-engagement position. Thus, as shown in FIG. 10A, the flap portion 212 of the lever locking portion 21 may interfere with the attached wiring harnesses 3 extending backward from the rear portion 11*b* of the housing 11. In the configuration of the lever locking portion 21, the flap portion 212, which is suspended from the base portion 211, extends in the direction substantially tangent to the rotational movement of the lever 14. Thus, the flap portion 212 is movable so as to seesaw on the base portion 212 that serves as a fulcrum. In addition, a rear end portion 212*a* of the flap portion 212 may facilitate the interference with the wiring harnesses 3 rather than an opposite end portion of the flap portion 212. This way, even if the rear end portion 212*a* interferes with the wiring harnesses 3, the rear end portion 212*a* is moved upward, and the detent 213 disposed at the opposite end portion is displaced downward. In other words, as is apparent from FIG. 10A, the displacement of the detent 213, at the final engagement position, allows the engagement with the engagement surface 18*b* of the engagement portion 18 to become deeper. According to this embodiment, even if the lever locking portion 21 becomes deformed due to the interference with the wiring harnesses 3 for prolong periods of time, the deformation is in a direction such that increases engagement between the detent 213 and the engagement portion 18. Advantageously, the engagement of the lever locking portion 21 with the engagement portion 18 is reliably assured, preventing unintentional separation of the connectors.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A connector comprising:

a housing;

at least one pivot disposed on the housing;

a lever having a beam and configured to rotate on the pivot within a range from a first position to a second position, wherein the lever has a recess configured to fit a boss disposed on a mating connector therein in accordance with rotational movement of the lever;

a engaging portion disposed on the housing; and a locking portion disposed on the beam, wherein the locking portion comprises:

a base portion extending downward from the beam;

a flap portion supported by the base portion and extending in a direction substantially tangent to the rotational movement; and a detent disposed in proximity of a first free end of the flap portion and configured to engage with the engaging portion at the second position.

2. The connector according to claim 1, wherein the engaging portion is disposed at a rear, top portion of the housing.

3. The connector according to claim 1, wherein the locking portion is positioned in proximity of the middle of the beam.

4. The connector according to claim 3, wherein the beam has a protrusion disposed in proximity of the locking portion to protect the flap.

5. The connector according to claim 1, wherein the detent extends downward from the flap portion.

6. The connector according to claim 1, wherein the flap has a second free end positioned on an opposite side of the first free end.

7. The connector according to claim 6, wherein the flap is configured to be movable by an external force applied thereto so as to seesaw with a fulcrum at which the base portion supports the flap.

8. The connector according to claim 7, wherein the detent moves downward when the external force is applied to a portion in proximity of the second free end.

9. The connector according to claim 1, further comprising a plurality of wiring harnesses inserted into the housing from a rear portion of the housing.

10. The connector according to claim 9, wherein the engaging portion is disposed at a rear, top portion of the housing.

11. The connector according to claim 9, wherein the beam has a protrusion disposed in proximity of the locking portion to protect the flap.

12. The connector according to claim 10, wherein a size and shape of the protrusion is selected such that an amount of interference of the flap with the plurality of wiring harnesses is adjusted.

13. The connector according to claim 9, wherein the second free end interferes with the plurality of wiring harnesses at the first position such that the second free end is moved upward.

14. The connector according to claim 1, wherein the lever has at least two arm portions to support the beam on both sides of the beam, wherein the two arm portions are supported pivotally by at least the two pivots disposed on both side surfaces of the housing.

15. The connector according to claim 1, further comprising a stopper disposed on the housing and configured to stop the lever at the first position, wherein the stopper releases the lever by the rotational movement of the lever.

16. A connector set comprising:

a first connector, wherein the first connector comprises:

a first housing; and a boss disposed on the first housing; and a second connector, wherein the female connector comprises:

a female housing to fit into the first housing;

at least one pivot disposed on the second housing;

a lever having a beam and configured to rotate on the pivot within a range from a first position to a second position, wherein the lever has a recess configured to fit the boss of the first connector therein in accordance with rotational movement of the lever;

a engaging portion disposed on the female housing; and a locking portion disposed on the beam, wherein the locking portion comprises:

a base portion extending downward from the beam;

a flap portion supported by the base portion and extending in a direction substantially tangent to the rotational movement; and a detent disposed in proximity of a first free end of the flap portion and configured to engage with the engaging portion at the second position.

* * * * *

UNITED STATES PATENT AND TRADEMARK OFFICE

CERTIFICATE OF CORRECTION

PATENT NO. : 7,052,294 B1
APPLICATION NO. : 11/107233
DATED : May 30, 2006
INVENTOR(S) : Tsuyoshi Osada It is certified that error appears in the above-identified patent and that said Letters Patent is hereby corrected as shown below:

In the Claims:

At column 6, claim number 16, line number 65, “female” should read --second--.

At column 6, claim number 16, line number 67, “female” should read --second--.

At column 7, claim number 16, line number 7, “female” should read --second--.

Signed and Sealed this
Twenty-ninth Day of March, 2016

Michelle K. Lee

Michelle K. Lee
*Director of the United States Patent and Trademark Office*